US010800000B2

(12) United States Patent
Tolles et al.

(10) Patent No.: US 10,800,000 B2
(45) Date of Patent: Oct. 13, 2020

(54) MULTI-LAYERED NANO-FIBROUS CMP PADS

(71) Applicant: Applied Materials, Inc., Santa Clara, CA (US)

(72) Inventors: Robert D. Tolles, San Jose, CA (US); Mahendra C. Orilall, Downingtown, PA (US); Fred C. Redeker, Fremont, CA (US); Rajeev Bajaj, Fremont, CA (US)

(73) Assignee: APPLIED MATERIALS, INC., Santa Clara, CA (US)

( * ) Notice: Subject to any disclaimer, the term of this patent is extended or adjusted under 35 U.S.C. 154(b) by 0 days.

(21) Appl. No.: 15/546,068

(22) PCT Filed: Jan. 29, 2016

(86) PCT No.: PCT/US2016/015698
§ 371 (c)(1),
(2) Date: Jul. 25, 2017

(87) PCT Pub. No.: WO2016/123505
PCT Pub. Date: Aug. 4, 2016

(65) Prior Publication Data

US 2018/0009079 A1 Jan. 11, 2018

Related U.S. Application Data

(60) Provisional application No. 62/110,454, filed on Jan. 30, 2015.

(51) Int. Cl.

| | |
|---|---|
| ***B24B 37/22*** | (2012.01) |
| ***B24B 37/24*** | (2012.01) |
| ***B24D 11/00*** | (2006.01) |

(52) U.S. Cl.
CPC ..... *B24B 37/22* (2013.01); *B24B 37/24* (2013.01); *B24D 11/00* (2013.01)

(58) Field of Classification Search
CPC ..... B24B 37/22; B24B 37/24; B24D 11/00
(Continued)

(56) References Cited

U.S. PATENT DOCUMENTS 2,121,496 A * 6/1938 Bowen ..... B24D 13/02 28/112
2,958,593 A * 11/1960 Hoover ..... A47L 13/04 451/532

(Continued)

FOREIGN PATENT DOCUMENTS

CN 102601727 A 7/2012
JP 2013-141716 A 7/2013

(Continued)

OTHER PUBLICATIONS

Chinese Office Action dated Nov. 30, 2018 for Application No. 201680007688.3.

(Continued)

*Primary Examiner* — Eileen P Morgan
(74) *Attorney, Agent, or Firm* — Patterson + Sheridan LLP

(57) ABSTRACT

The present disclosure relates generally to a polishing article, and apparatus and methods of chemical mechanical polishing substrates using the polishing article. In some embodiments, the polishing article, such as a polishing pad, includes multiple layers in which one or more layers (i.e., at least the top layer) includes a plurality of nano-fibers that a positioned to contact a substrate during a polishing process. In one embodiment, a polishing article comprises a layer having a thickness less than about 0.032 inches, and the (Continued)

layer comprising fibers having a diameter of about 10 nanometers to about 200 micro meters.

20 Claims, 3 Drawing Sheets

(58) Field of Classification Search
USPC ..... 451/532
See application file for complete search history.

(56) References Cited

U.S. PATENT DOCUMENTS

2002/0123298 A1* 9/2002 Krusell ..... B24B 21/04 451/5
2004/0029489 A1* 2/2004 Tsujimura ..... B24B 21/04 451/5
2004/0102045 A1 5/2004 Chopra et al.
2010/0075578 A1* 3/2010 Chou ..... B24D 11/00 451/59
2010/0087128 A1* 4/2010 Nakayama ..... B24B 37/24 451/548
2012/0302142 A1* 11/2012 Feng ..... B24B 37/24 451/59
2013/0122773 A1* 5/2013 Wahal ..... B29C 48/30 442/400
2013/0157551 A1* 6/2013 Endo ..... B24D 11/00 451/532
2013/0331014 A1* 12/2013 Shiro ..... B24B 37/24 451/532
2017/0203406 A1* 7/2017 Ganapathiappan .... B33Y 10/00
2018/0036866 A1* 2/2018 Alkhas ..... B24D 3/14

FOREIGN PATENT DOCUMENTS

JP 2013-169627 A 9/2013
WO WO-9522438 A1 * 8/1995 ..... B24D 11/02

OTHER PUBLICATIONS

Chinese Office Action for Application No. 201680007688.3 dated Aug. 1, 2019.

* cited by examiner

MULTI-LAYERED NANO-FIBROUS CMP PADS

BACKGROUND

Field

Embodiments of the disclosure generally relate to apparatus and methods for chemical mechanical polishing of substrates or wafers, more particularly, to a polishing article manufacturing system and a method of manufacturing and using a polishing pad or polishing article for chemical mechanical polishing.

Description of the Related Art

Chemical mechanical polishing (CMP) is a conventional process that has been used in many different industries to planarize surfaces of substrates. In the semiconductor industry, uniformity of polishing and planarization has become increasingly important as device feature sizes continue to decrease. During a CMP process, a substrate, such as a silicon wafer, is mounted on a carrier head with the device surface placed against a rotating polishing pad. The carrier head provides a controllable load on the substrate to push the device surface of the substrate against the polishing pad. A polishing liquid, such as slurry with abrasive particles, is typically supplied to the surface of the moving polishing pad and polishing head. The polishing slurry, including an abrasive and at least one chemically-reactive agent, is typically supplied to the polishing pad to provide an abrasive chemical solution at the interface between the pad and the substrate. The polishing pad and polishing head apply mechanical energy to the substrate, while the pad also helps to control the transport of slurry which interacts with the substrate during the polishing process. An effective CMP process not only provides a high polishing rate, but also provides a substrate surface which lacks small-scale roughness, contains minimal defects and is flat, i.e., lacks large scale topography.

Chemical mechanical polishing processes performed in a polishing system will typically include multiple polishing pads that perform different parts of the full polishing process. The polishing system typically includes a first polishing pad that is disposed on a first platen, which produces a first material removal rate and a first surface finish and a first flatness on the surface of the substrate. The first polishing step is typically known as a rough polish step, and is generally performed at a high polishing rate. The system will also typically include at least one additional polishing pad that is disposed on at least an additional platen, which produces a second material removal rate and a second surface finish and flatness on the surface of the substrate. The second polishing step is typically known as a fine polish step, which is generally performed at a slower rate than the rough polishing step. In some configurations, the system may also include a third polishing pad that is disposed on a third platen, which produces a third removal rate and a third surface finish and flatness on the surface of the substrate. The third polishing step is typically known as a material clearing or buffing step. The multiple pad polishing process can be used in a multi-step process in which the pads have different polishing characteristics and the substrates are subjected to progressively finer polishing or the polishing characteristics are adjusted to compensate for different layers that are encountered during polishing, for example, metal lines underlying an oxide surface.

A recurring problem in CMP is non-uniformity of the polishing rate across the surface of the substrate. Additionally, the polishing pad generally deteriorates naturally during polishing due to wear and/or accumulation of polishing by-products on the pad surface. Eventually the polishing pad becomes worn or "glazed" after polishing a certain number of substrates, and then needs to be replaced or reconditioned. Glazing occurs when the polishing pad is heated and compressed in regions where the substrate is pressed against the pad. Due to the generated heat and applied forces, the high-points on the polishing pad are compressed and are spread-out such that the points between the high-points are filled up, thus making the polishing pad surface become smoother and less abrasive. As a result, the polishing time increases. Therefore, the polishing pad surface must be periodically returned to an abrasive condition, or "conditioned", to maintain a high throughput. Conventionally, an abrasive conditioning disk is used to essentially "scratch" or "abrade" the top layer of the polishing pad surface into a state so that desirable polishing results can once again be achieved on the substrate.

However, the pad conditioning process takes considerable time, it generates particles and may shorten the lifetime of the polishing pad, which increases cost of ownership and reduce process yield. Additionally, conditioning may cause large asperities to form on the surface of the polishing pad which may scratch the substrate and/or create polishing related defects on the substrate.

Therefore, there is a need for an improved CMP polishing pad that addresses some of the aforementioned concerns.

SUMMARY

Embodiments of the disclosure generally relate to an apparatus and method of chemical mechanical polishing substrates or wafers. More particularly, to a polishing article manufacturing system and a method of manufacturing and using a polishing article for chemical mechanical polishing.

In one embodiment, a polishing article comprises a layer having a thickness less than about 0.032 inches, and the layer comprising fibers having a diameter of about 10 nanometers to about 200 micro meters.

In another embodiment, a method of removing material from a substrate includes urging a substrate toward a fibrous layer on a platen, the fibrous layer having a thickness less than about 0.032 inches and comprising fibers having a diameter of about 10 nanometers to about 200 micro meters, rotating the platen relative to the substrate, removing material from a surface of the substrate, and advancing the fibrous layer relative to the platen after removing material from the substrate.

In another embodiment, a method of removing material from a substrate includes urging a substrate toward a polishing material disposed on a supply roll across a platen to a take-up roll, the polishing material having a thickness less than about 0.032 inches and comprising fibers having a diameter of about 10 nanometers to about 200 micro meters, rotating the platen relative to the substrate, removing material from a surface of the substrate, and advancing the polishing material relative to the platen after removing material from the substrate.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

To facilitate understanding, common words have been used, where possible, to designate identical elements that are common to the figures. It is contemplated that elements disclosed in one embodiment may be beneficially utilized on other embodiments without specific recitation.

DETAILED DESCRIPTION

The present disclosure relates generally to a polishing article, and apparatus and methods of chemical mechanical polishing substrates using the polishing article. In some embodiments, the polishing article, such as a polishing pad, includes one or more layers (i.e., at least the top layer) that includes a porous structure formed by plurality of nano-fibers that are positioned and/or oriented to contact a substrate during a polishing process.

Figure 1:
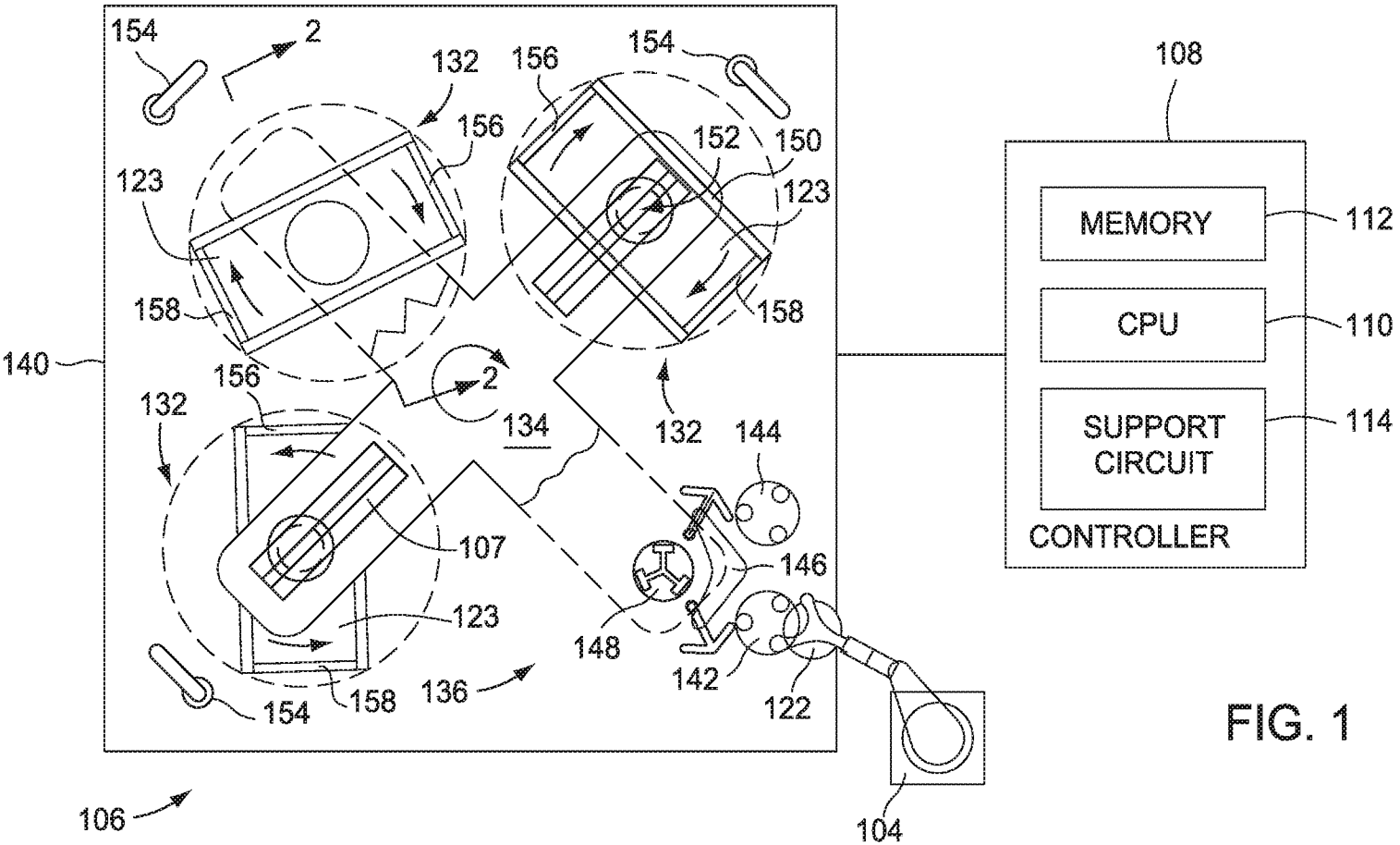
FIG. 1 is a plan view of an exemplary chemical mechanical polishing module, according to one or more embodiment disclosed herein.

FIG. 1 depicts a plan view of a polishing module 106 which may be a portion of a REFLEXION® Chemical Mechanical Polisher, such as the REFLEXION® WEBB™ system, manufactured by Applied Materials, Inc., located in Santa Clara, Calif. One or more of the embodiments described herein may be used on this polishing system. However, one skilled in the art may advantageously adapt embodiments as taught and described herein to be employed on other types of polishing devices produced by other manufacturers that utilize polishing articles, and particularly polishing articles in a roll-to-roll format.

The polishing module 106 generally comprises a loading robot 104, a controller 108, a transfer station 136, a plurality of processing or polishing stations, such as platen assemblies 132, a base 140 and a carousel 134 that supports a plurality of polishing or carrier heads 152 (only one is shown in FIG. 1). Generally, the loading robot 104 is disposed proximate the polishing module 106 and a factory interface 102 (not shown) to facilitate the transfer of substrates 122 therebetween.

The transfer station 136 generally includes a transfer robot 146, an input buffer 142, an output buffer 144 and a load cup assembly 148. The input buffer station 142 receives a substrate 122 from the loading robot 104. The transfer robot 146 moves the substrate 122 from the input buffer station 142 and to the load cup assembly 148 where it may be transferred to the carrier head 152.

To facilitate control of the polishing module 106 as described above, the controller 108 comprises a central processing unit (CPU) 110, support circuits 146 and memory 112. The CPU 110 may be one of any form of computer processor that can be used in an industrial setting for controlling various polishers, drives, robots and sub-processors. The memory 112 is coupled to the CPU 110. The memory 112, or computer-readable medium, may be one or more of readily available memory such as random access memory (RAM), read only memory (ROM), floppy disk, hard disk, or any other form of digital storage, local or remote. The support circuits 114 are coupled to the CPU 110 for supporting the processor in a conventional manner. These circuits include cache, power supplies, clock circuits, input/output circuitry, subsystems, and the like.

Generally, the carousel 134 has a plurality of arms 150 that each support one of the carrier heads 152. Two of the arms 150 depicted in FIG. 1 are shown in phantom such that the transfer station and a polishing article 123 are disposed on or over one of the platen assemblies 132 may be seen. The carousel 134 is indexable such that the carrier heads 152 may be moved between the platen assemblies 132 and the transfer station 136.

Typically, a chemical mechanical polishing process is performed at each platen assembly 132 by moving the substrate 122 retained in the carrier head 152 relative to the polishing article 123 supported on the platen assembly 132. The polishing article 123 may be stretched across the platen assembly 132, and between a supply assembly 156 and a take-up assembly 158. The supply assembly 156 and the take-up assembly 158 may provide an opposing bias to the polishing article 123 in order to tighten and/or stretch an exposed portion of the polishing article 123 disposed therebetween. In some embodiments, the polishing article 123 may have a flat or planar surface topology when stretched between the supply assembly 156 and the take-up assembly 158. Additionally, the polishing article 123 may be advanced across and/or be releasably fixed to the platen assembly 132 such that a new or unused area of the polishing article 123 may be released from the supply assembly 156. Typically, the polishing article 123 is releasably fixed by a vacuum pressure applied to a lower surface of the polishing article 123, mechanical clamps, or by other holding methods to the platen assembly 132.

Figure 3A:
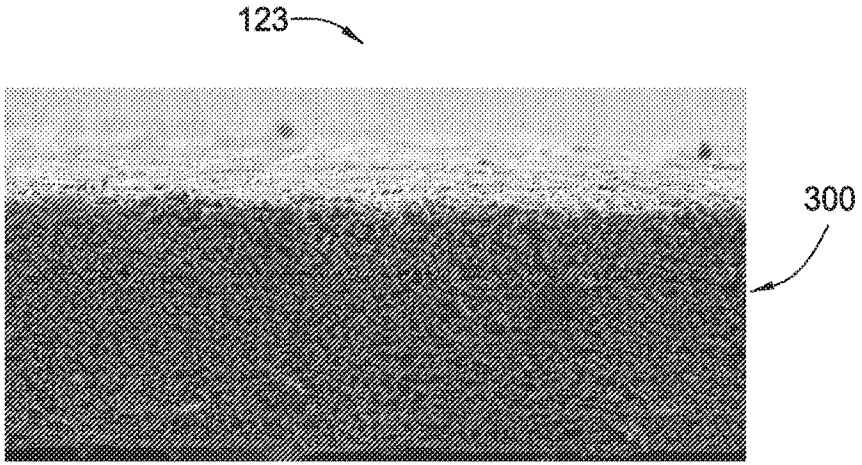
FIG. 3A illustrates a cross-section of nano-fibrous layer of a polishing article, according to embodiments disclosed herein.
Figure 4:
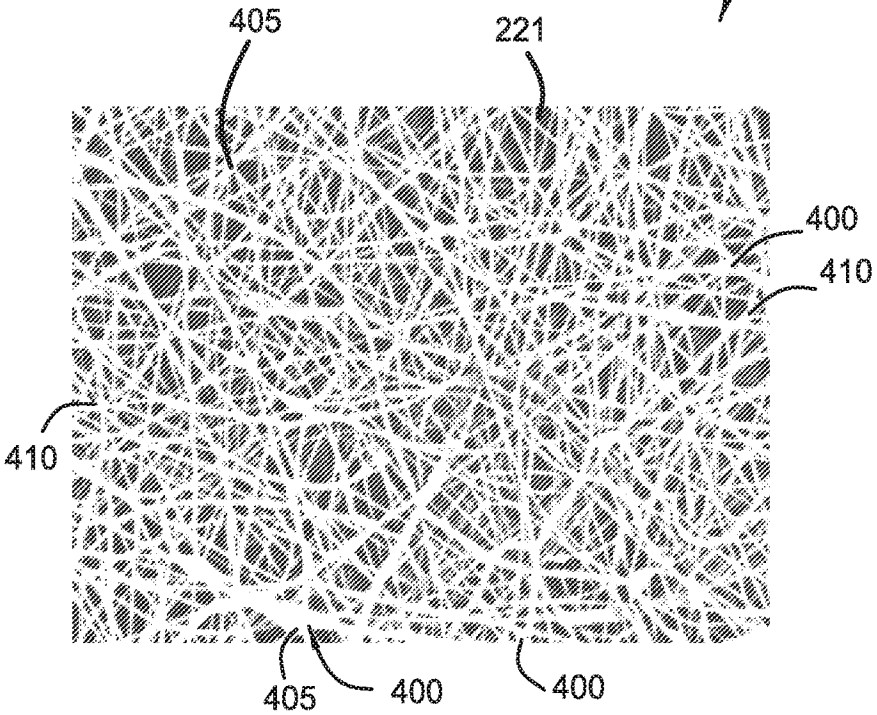
FIG. 4 is a magnified view of the nano-fibrous polishing article of FIG. 3B, according to embodiments disclosed herein.

The polishing article 123 may include nano-sized features (e.g., having sizes of about 10 nanometers to about 200 micrometers) that form a porous structure, as, for example, illustrated in FIGS. 3A and 4. The polishing process may utilize a slurry containing abrasive particles delivered to the polishing article's surface by fluid nozzles 154 to aid in polishing the substrate 122. Alternatively, the fluid nozzles 154 may deliver de-ionized water (DIW) alone, or in combination with polishing chemicals. The fluid nozzles 154 may rotate in the direction shown to a position clear of the platen assemblies 132 as shown, to a position over each of the platen assemblies 132.

Figure 2:
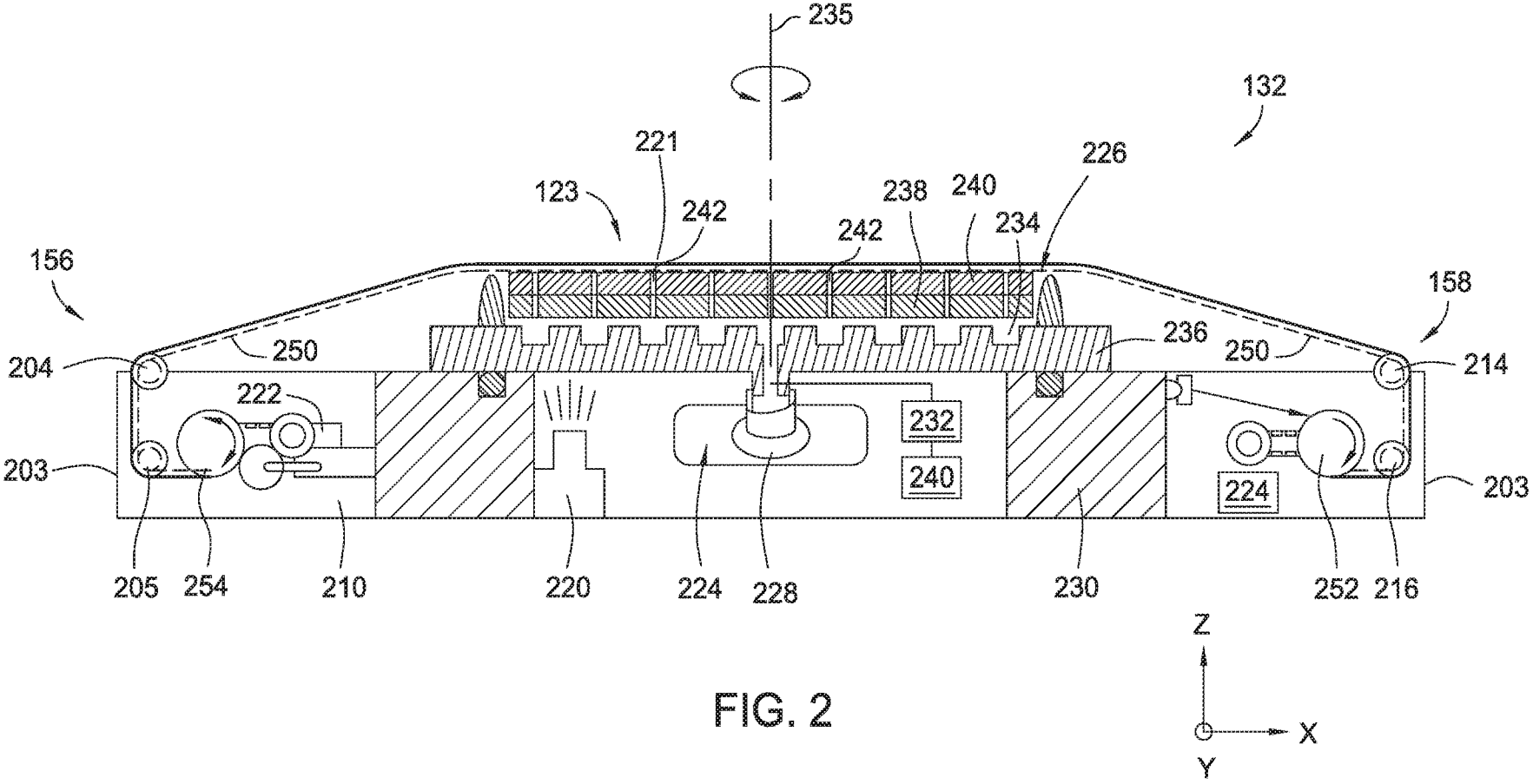
FIG. 2 is a sectional view of an exemplary processing station of the module of FIG. 1, according to one or more embodiments disclosed herein.

FIG. 2 depicts a side view of the platen assembly 132 and an exemplary supply assembly 156 and a take up assembly 158, illustrating the position of the polishing article 123 across a platen 230. Generally, the supply assembly 156 includes the supply roll 254, an upper guide member 204 and a lower guide member 205 that are disposed between a side wall 203 of the platen assembly 132. Generally, the take-up assembly 158 includes the take-up roll 252, an upper guide member 214 and a lower guide member 216 that are all disposed between the sidewalls 203. The take-up roll 252 generally contains a used portion of polishing article 123 and is configured so that it may easily be replaced during a maintenance activity with an empty take-up roll once take-up roll 252 is filled with used polishing article 123. The upper guide member 214 is positioned to lead the polishing article 123 from the platen 230 to the lower guide member 216. The lower guide member 216 leads the polishing article 123 onto the take-up roll 252.

The platen assembly 132 may also include an optical sensing device 220, such as a laser, that is adapted to transmit and receive optical signals for detecting an endpoint to the polishing process performed on a substrate that is urged against the top surface of the polishing article 123 (FIG. 2). In some embodiments, the optical sensing device is configured to optically inspect a surface of a substrate through the thickness of the nano-sized features formed within the polishing article 123. In this configuration, the optical sensing device projects radiation through the polishing article 123 and receives at a detector (not shown) any radiation reflected from the surface of the substrate that passes back through the porous structure of the polishing article 123.

The supply roll 254 generally contains an unused portion of polishing article 123 and is configured so that it may easily be replaced with another supply roll 254 containing a new polishing article 123 once the polishing article 123 disposed on the supply roll 254 has been consumed by the polishing or planarizing process. In general, the total length of the polishing article 123 includes an amount of material disposed on the supply roll 254, an amount disposed on the take-up roll 252, and an amount that extends between the supply roll 254 and the take-up roll 252. The total length is typically larger than the size of the polished surface of multiple substrates 122 (FIG. 1), and may be for example several meters to several tens of meters long.

The polishing article 123 is generally configured to controllably advance the polishing article 123 in the X direction across a backing pad assembly 226. The polishing article 123 is generally moved in relation to the platen 230 by balancing the forces between a motor 222 coupled to the supply assembly 156 and a motor 224 coupled to the take-up assembly 158. Ratchet mechanisms and/or braking systems (not shown) may be coupled to one or both of the supply assembly 156 and the take-up assembly 158 to fix the polishing article 123 relative to the backing pad assembly 226. The platen 230 may be operably coupled to a rotary actuator 228 that rotates the platen assembly 132 about a rotational axis 235 generally orthogonal to the X and/or Y directions. In some embodiments, all of the elements shown in FIG. 2 rotate about the rotational axis 235.

A vacuum system 232 may be coupled between the actuator 228 and the backing pad assembly 226. The vacuum system 232 may be used to fix the position of the polishing article 123 onto the platen 230. The vacuum system 232 may include channels 234 formed in a plate 236 disposed below the backing pad assembly 226. In one embodiment, the backing pad assembly 226 may include a sub-pad 240 and a subplate 238, each having openings 242 formed therethrough that are in fluid communication with the channels 234 and a vacuum source 244. In other embodiments, an integral sub-pad 250 (shown in dashed lines) may be formed on a lower surface of the polishing article 123. In one embodiment of the platen assembly 132, a sub-pad 240 and an integral sub-pad 250 of the polishing article 123 are used in combination during a polishing process. In some embodiments, the sub-pad 240 and/or the integral sub-pad 250 is typically formed from a polymeric, elastomeric or plastic material, such as polycarbonate or foamed polyurethane. Generally, the hardness or durometer of the sub-pad 240 and/or the integral sub-pad 250 may be chosen to produce a particular polishing result. The sub-pad 240 and/or the integral sub-pad 250 generally maintains an upper surface 221 of the polishing article 123 in a plane that is parallel to the plane of a substrate (not shown) in order to promote global planarization of the substrate. In some embodiments, the subplate 238 may be positioned below the sub-pad 240, as shown. The sub-pad 240 and/or the integral sub-pad 250 may be hydrophilic or hydrophobic. If the sub-pad 240 and/or the integral sub-pad 250 is hydrophilic, the sub-pad 240 and/or the integral sub-pad 250 should be configured to absorb in a uniform manner.

According to embodiments described herein, the polishing article 123 is relatively thin and a sub-pad, such as the sub-pad 240 and/or the integral sub-pad 250, is utilized to increase the mechanical integrity of the polishing article and/or provide the necessary compliance to improve and/or adjust the polishing performance of the polishing article 123. Additionally or alternatively, the hydrophobic or hydrophilic nature of the sub-pad 240 and/or the integral sub-pad 250 may retain and/or disperse slurry more uniformly. Additionally or alternatively, the hardness and/or structure of the sub-pad 240 and/or the integral sub-pad 250 may provide additional compliance to the polishing article 123.

In one embodiment, a sub-pad (e.g., sub-pad 240 and/or the integral sub-pad 250), is made of a polyurethane material having a thickness from 1 mm-2 mm, and hardness of about 50-65 Shore D, is used with the polishing article 123. In some embodiments, the nano-fibrous layer having a thickness of 50-100 μm can subsequently be adhered to a portion of the integral sub-pad 250, or directly fabricated onto the integral sub-pad 250, using either electrospinning or centrifugal spinning techniques.

In some embodiments, the sub-pad 240 can have a variety of grooving formed across the surface that contacts the polishing article 123, including concentric grooves or an array of pillars having diameters of 30 μm to 200 μm with a varying pitch. In some configurations, the grooves are in communication with a vacuum source via the openings 242, and thus may be used to help distribute the vacuum pressure applied to a lower surface of the polishing article 123, as discussed above, during processing.

In another embodiment, a combination of two types of sub-pads are used where a first sub-pad is made of polyurethane and have a thickness of 1-2 mm, a hardness less than 50 Shore D, and no grooving pattern. The second sub-pad, also made of polyurethane having a thickness from 1 mm-2 mm, and a hardness of 50-65 shore D, is used. In some embodiments, a single sub-pad may be used, or a combination of the first and second sub-pad described above, and may include a hardness of about 60 Shore A to about 30 Shore D. This second sub-pad may be placed directly over the first sub-pad. The nano-fibrous layer of a thickness of 50-100 μm can subsequently be adhered to this sub-pad or directly fabricated onto the sub-pad, using either electrospinning or centrifugal spinning techniques. In another embodiment, the sub-pads are made of a different material, other than polyurethane. In another embodiment, the top sub-pad contains micro-pores in order to assist in slurry retention and/or slurry transportation.

Conventionally, CMP polishing pads are usually made of polymeric materials such as polycarbonates, nylons, polysulfones, and polyurethanes. Typically, conventional CMP pads are made by molding, casting, extrusion, web coating, or sintering these materials. Conventional pads may be made one at a time or as a cake which is subsequently sliced into individual pad substrates. These substrates are then machined to a final thickness and grooves are further machined onto them. Typical polymer or polymer/fiber circular pads are 0.050 inches to 0.125 inches thick.

The conventional polymer based CMP polishing pads are typically adhered using PSA (pressure sensitive adhesive) to a flat rotating circular table within a CMP machine. A substrate is placed in contact with the pad using a down-force of about 1 psi to about 6 psi in the presence of a chemically and mechanically active slurry which results in removal of the film from the substrate. The conventional pad is typically used in conjunction with pad conditioning to stabilize the film removal rate. When the pad surface has been abraded or loaded with polishing byproducts to an extent that can no longer sustain desirable and/or stable polishing performance, the pad must be removed and replaced with another new pad and the machine re-qualified for production. The pad material and the type of pad conditioning required to achieve a desired polishing performance are key to the availability of the polisher for use in the device fabrication factory. A short pad lifetime and frequent pad replacement results in poor polisher availability as well as increasing cost of ownership.

As mentioned above, conventional CMP pads need periodic conditioning to maintain acceptable removal rates, and conditioning may produce undesirable debris and/or shorten the lifetime of the pad. The debris is known to contribute to higher defect levels including microscratches. Additionally, for the required strength and to improve other polishing related properties, conventional pads are relatively thick in cross-section, which limits the amount of pad material that could be wound on a supply roll. One or more of these drawbacks increases downtime and/or yield, which increases cost of ownership.

The polishing article 123 as described herein is generally thinner than conventional CMP pads while maintaining desirable polishing characteristics and material properties (e.g., wettability, strength) and does not require pad conditioning. Utilizing the polishing article 123 as described herein, defects caused by foreign debris which enter the polishing region (the pad/substrate interface), would be less likely to result in substrate scratching as a particle could "fall into" the interstitial spaces (e.g., pores) formed between the layer of fibers. If a particle is larger than an interstitial space in the polishing article 123, the particle might protrude from the pad surface. However, depending on the particle size versus the pad thickness, it is believed that a "large" particle will typically not generate a scratch on the substrate surface when the polishing article 123 is used, since the fiber containing layer(s) will generally not provide a enough localized structural support to generate a force large enough to create a scratch on the substrate. The structural support provided by the fiber containing layer is generally limited due to the small cross-sectional area of each of the supporting fibers in the fiber containing layer, and the limited contact and support provided by adjacently positioned fibers disposed in the fiber containing layer. It is believed that the particle would likely become wedged into the local pad fiber structure, which may locally deform under an applied load delivered during a polishing process. Lastly, a "scratch capable" particle is less likely to be "wedged" between a round fiber and the substrate, characterized by a line contact fiber to substrate.

In contrast to conventional pad materials, the fiber mat polishing article 123 may not need conditioning beyond water rinsing with a water jet or water flow, and/or use of a soft brush in order to remove polishing byproducts. Thus, no destructive conditioning as seen with diamond disks used with the conventional pad is envisioned. The fiber thickness and the attachment of the fibers to the backing may not be sufficient to withstand aggressive conditioning methods.

The polishing article 123 as described herein includes a thickness that is less than a conventional CMP pad, which allows a longer length of the polishing article material to be disposed on the same sized supply roll, and thus reduces the supply roll's weight. A supply roll that has a longer useable length disposed thereon will extend the number of substrates that can be polished within a polishing tool over an extended period of time, since the overhead time required to replace and qualify a new length of a supply roll material each time the supply roll runs out of useable material is minimized. Additionally, the polishing article 123 as described herein includes sufficient mechanical integrity, is chemically resistive (i.e., able to survive the aggressive slurry chemistries used in CMP polishing without degrading, delaminating, blistering or warping), and may be sufficiently hydrophilic such that aqueous-based abrasive containing slurry wets the surface of the pad. The polishing article 123 as described herein possesses a high strength to resist tearing during polishing, acceptable levels of hardness and modulus (depending on material being polished) for planarity, good abrasion resistance to prevent excessive pad wear during polishing, and retain mechanical properties when wet. Utilizing the polishing article as described herein with hydrophilic fibers may absorb the polishing agent/liquid more readily. Depending on the diameter of the fibers and the size of the slurry particles, some particles may adhere or be captured in the outer hydrated shell of the fiber.

In one embodiment, the polishing article 123 may include a porous structure formed from nano-fibers. The nano-fibers can be produced by electrospinning or centrifugal-spinning techniques as well as three-dimensional (3D) printing techniques. A 3D printing process as described herein may include, but is not limited to, polyjet deposition, inkjet printing, fused deposition modeling, binder jetting, powder bed fusion, selective laser sintering, stereolithography, vat photopolymerization digital light processing, sheet lamination, directed energy deposition, among other 3D deposition or printing processes. In electrospinning or centrifugal-spinning techniques, the nano-fibers can be produced by either melt or solution spinning.

The polishing article 123 as described herein having a nano-fiber structure, may alleviate the need to condition the polishing article and thus maximize polisher availability and polisher performance. For example, the polishing article 123 may be incrementally advanced to present fresh polishing material in lieu of abrasive conditioning.

In some embodiments, the polishing article 123 consists of, or consists essentially of, random nano-sized fibers with only air therebetween. In other embodiments, the polishing article 123 consists of, or consists essentially of, random nano-sized fibers with only a coating that adheres the fibers together at intersections of the fibers. Thus, the polishing article 123 is exceptionally light and/or less dense than conventional polishing materials, but with exceptional mechanical strength to resist tearing or other damage.

Figure 3B:
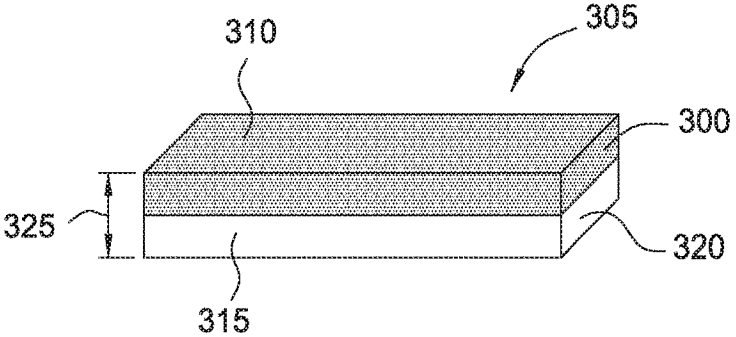
FIG. 3B is a schematic diagram of a multi-layered nano-fibrous polishing article, according to embodiments disclosed herein.

FIG. 3A illustrates a cross-section of nano-fibrous layer 300 of a polishing article 123 and FIG. 3B is a schematic diagram of a multi-layered nano-fibrous polishing article 305 according to embodiments disclosed herein. The nano-fibrous polishing article 305 may be used as the polishing article 123 shown in FIGS. 1 and 2. The nano-fibrous polishing article 305 may include a first layer 310 and a second layer 315. The second layer 315 may be used to support the first layer 310 when a force is applied to a polishing surface of the first layer 310. The first layer 310 may be the nano-fibrous layer 300 shown in FIG. 3A. The second layer 315 may be a sub-pad (e.g., the integral sub-pad 250 shown in FIG. 2) or backing layer 320, or another layer similar to the nano-fibrous layer 300.

A thickness 325 of the polishing article 305 may be about 0.007 inches to about 0.001 inches which allows much more polishing material to be wound on a supply roll. The increased length of the polishing article 123 wound on the supply roll lengthens the time between replacement of the supply roll and therefore reduces the number of qualification periods which decreases a polishing system's downtime. The thickness 325 may include one or both of the first layer 310 the second layer 315. If the second layer 315 includes the backing layer 320, the backing layer 320 may be very thin (e.g., about 10% to about 15% of the thickness 325). The backing layer 320, when utilized, and may be sprayed onto the first layer 310. The backing layer 320 may be hydrophilic or hydrophobic. If the backing layer 320 is hydrophilic, the backing layer 320 may be configured to absorb in a uniform manner. In some embodiments, the second layer 315 is similar to, or includes, the integral sub-pad 250 described above.

FIG. 4 is a magnified view of the nano-fibrous polishing article 305 of FIG. 3B. The upper surface 221 of the nano-fibrous polishing article 305 is shown having a plurality of nano-fibers 400. The nano-fibers 400 may have diameters ranging from about 20 nm to about-900 nm. Intersections 405 where the nano-fibers 400 cross each other and may at least partially contact each other are formed across and/or through a portion of the polishing article 305. The structural support provided by the nano-fibers 400 to a load directed normal to the page of FIG. 4 (e.g., the polishing surface 221 of FIG. 2) is generally limited due to the small cross-sectional area of each of the fibers and the limited contact, and thus support, provided by adjacently positioned fibers disposed in the nano-fibrous polishing article 305.

A layer of nano-fibers 400 (e.g., the first layer 310) can have a thickness of about 10 micro-meters (μm) to about 100 μm. The nano-fiber diameters can be about 10 nm to about 10 μm. Fiber density can range from about 0.05 grams per cubic centimeter ($g/cm^3$) to about 100 $g/cm^3$, such as about 0.1 $g/cm^3$ to about 50 $g/cm^3$. It is believed that the addition of or use of one or a combination of smaller and denser fibers adds additional structural integrity to the polishing article 305.

In some embodiments, a coating may be applied to the surface of the nano-fibrous polishing article 305. In this case, the intersections 405 of the fibers may include an amount of the coating 410 that is used to bind the nano-fibers 400 together, which provides additional strength to the polishing article 305. The coating 410 may include an organic or polymeric type of coating. The coating 410 can also be used to alter the surface energy of the nano-fibers to make the exposed surfaces more or less hydrophilic or hydrophobic. In one example, the coating may include polymeric and/or polyurethane coatings. The coating 410 may include abrasive particles (not shown) to assist in material removal during a polishing process.

In some embodiments, the nano-fibers 400 may form a nano-fibrous layer that can be produced directly onto the other layers of the polishing article 123 (i.e., a sub-pad which acts as a substrate for the deposition of the nano-fibers and ultimately functions as a sub-pad for the polishing article 305). Alternatively, the nano-fibrous layer can be produced as a stand-alone layer which can then be subsequently be attached to the other layers of a sub-pad in a separate step. The nano-fibers 400 can be polymer nano-fibers or polymer-inorganic nano-fibers having sizes of about 10 nanometers (nm) to about 200 nm.

The random nature of the nano-fibers that are deposited onto a backing material, as shown in FIG. 4, is believed to create a predictable polishing surface. The deposition may be so random that it will produce a polishing surface that is uniform. In some embodiments, long continuous fibers may be deposited while in other embodiments shorter of fibers may be used. The fibers can be created through centrifugal force, electrospinning or meltblown, or 3D printing. In some embodiments the fibers can be used, as deposited, onto the backing material. In other embodiments, other materials may be used to coat the fibers, creating attachment points. However, the properties of the fiber mat produced may not be dominated by the coating material properties (like conventional pads filled with urethane).

In some embodiments, to form the nano-fibrous layer within a polishing article an electrospinning type deposition technique may be used. Electrospinning involves the continuous stretching of polymers in solution/melt in the presence of an electric field to form ultrathin fibers. In some configurations, a needle-less technique can also be employed. In this case, when a sufficiently high voltage is applied to a liquid droplet or film of the polymer solution/melt, the body of the liquid becomes charged, and electrostatic repulsion counteracts the surface tension and the polymer droplet is stretched. At a critical point a stream of liquid erupts from the surface of the solution. This point of eruption is often known as the Taylor cone. If the molecular cohesion of the liquid is sufficiently high, stream breakup does not occur (if it does, droplets are electrosprayed) and a charged liquid jet is formed. As the jet dries in flight, the mode of current flow changes from ohmic to convective as the charge migrates to the surface of the fiber. The jet is then elongated by a whipping process caused by electrostatic repulsion initiated at small bends in the fiber, until it is finally deposited on a grounded collector. The elongation and thinning of the polymer solution/melt resulting from this bending instability generally leads to the formation of uniform fibers with nanometer scale diameters. For polymers that are electrospun from solution, the weight % of the polymer can be about 5-30 wt %. In cases where the polymer fibers are electrospun, the voltage supplied while electrospinning may be configured to supply between about 20 kV to 120 kV. The spinning distance while electrospinning can range between 1 mm to 1,000 mm. One or more layers of the polishing article 305 can include polyurethanes, polycarbonates, nylons, polysulfones, polyvinyl chloride, polymetyl methacrylate, polyvinyl alcohol, polyacrylamide, and polypropylene, polystyrene, polyethylene, polybutadiene, and poly acrylates.

A formed fiber layer may be further processed by compressing the deposited fibers with calendar rollers (i.e., heat and pressure) to compact the material and to create a smooth, planar surface. The fiber density of the formed first layer 310 of the polishing article 305 after being processed may be characterized by the relative ease with which air passes through the thickness of the polishing article (e.g., air permeability). The resistance to the movement of air through the thickness of the polishing article can be used as a measure or gauge of the "openness" of the pores in the fiber layer. When polishing substrates that have a surface topography (e.g., surface feature), it is contemplated that the porous fiber layer will provide fast and improved response to local load changes depending on the compression of the surface feature into the pad. It is contemplated that improved planarization may occur if the fibers "relax" between the features rather than acting like a rigid structure (e.g., stiff "beam") typical of more rigid conventional pads, such as cast polymer polishing pads. With a conventional pad, erosion of valleys between surface features formed on a substrate occurs only if the flexibility of the conventional pad allows the contact to be achieved at a supplied polishing load. It is contemplated that a polishing article 305 will behave differently in this situation as the structural rigidity of the nano-fibers at the polishing surface of the fiber layer is compliant due to the small cross-sectional area of each of the supporting fibers in the fiber layer and/or the limited support provided and contact between adjacently positioned fibers disposed in the fiber containing layer.

In cases where polymer-inorganic nano-composites are formed within at least a portion of the polishing article, the inorganic content can be about 1-30%. The pad may include ceramic particles that have a size between about 5 nm to about 0.3 μm (no more than about 50% the size of the fiber diameter). The particles may be less than 300 nm in diameter, or less than 100 nm in diameter, and more typically from about 10-20 nm in diameter. The nano-fibrous layer can have a thickness from 10 μm-100 μm.

In the case of the nano-fibers that are formed from polymer-inorganic nano-fibers, the inorganic content can be added to the polymer solution/melt either as nano-particles or as precursors for the corresponding sol-gel reaction to that inorganic moiety a typical sol-gel reaction involves the hydrolysis of metal salts or nonhydrolysis reactions such as $TiCl_4$ and $Ti(OH)_4$. (the latter two react to form $TiO_2$). Polymers that can be used include: polyurethane, carboxymethyl cellulose (CMC), nylon-6,6, polyacrylic acid (PAA), polyvinyl alcohol (PVA), polylacetic acid (PLA), polyethylene-co-vinyl acetate, PEVA/PLA, polymethyacrylate (PMMA)/tetrahydroperfluorooctylacrylate (TAN), polyethylene oxide (PEO), polymethacrylate (PMMA), polyamide (PA), polycaprolactone (PCL), polyethyl imide (PEI) polycaprolactam, polyethylene (PE), polyethylene terephthalate (PET), polyolefin, polyphenyl ether (PPE), polyvinyl chloride (PVC), polyvinylidene chloride (PVDC), polyvinylidene fluoride (PVDF), poly(vinylidenefluoride-co-hexafluoropropylene (PVDF-HFP), polyvinyl-pyridine, polylactic acid (PLA), polypropylene (PP), polybutylene (PB), polybutylene terephthalate (PBT), polyamide (PA), polyimide (PI), polycarbonate (PC), polytetrafluoroethylene (PTFE), polystyrene (PS), polyester (PE), acrylonitrile butadiene styrene (ABS), poly(methyl methacrylate) (PMMA), polyoxymethylene (POM), polysulfone (PES), styrene-acrylonitrile (SAN), polyacrylonitrile (PAN), styrenebutadiene rubber (SBR), ethylene vinyl acetate (EVA), styrene maleic anhydride (SMA). This set of polymers can also be used as the material for any of the other layers of the pad. Inorganic entities include, $SiO_2$, $CeO_2$, $TiO_2$, $Al_2O_3$ $BaTiO_3$, $HfO_2$, $SrTiO_3$, $ZrO_2$, $SnO_2$, MgO, CaO, $Y_2O_3$, $CaCO_3$, among others. These inorganic moieties can also be used in any of the other layers of the pad. In embodiments where a polymer/inorganic polishing article 305 is employed, the pad can function as a fixed abrasive pad.

The multi-layered nano-fibrous CMP pad, such as the polishing article 305, addresses current high value problems in the CMP market today. The advantages include controlled surface flatness for polishing pressure uniformity, reduced pad surface topography variation, reduced pad-to-pad topography variation, elimination of the need for pad conditioning, longer pad life, improved planarization efficiency, improved polishing result reproducibility, improved removal rate, selectivity and polishing uniformity, as well as defect minimization.

Roll-to-Roll Polishing Articles

In one embodiment, the polishing article 123 and/or the polishing article 305 comprises a thin pad having a backing material to which nano-fibers are adhered to form a fibrous polishing layer. The pad thickness may range from 0.005 inches to 0.100 inches, such as about 0.010 inches to about 0.030 inches. While the polishing article 305 has been described herein as a roll-to-roll polishing article, the polishing article 305 may be cut or machined into any shape for use in other polishing systems, such as round pad polishing systems.

The polishing apparatus depicted in FIG. 2, which includes a roll of polishing material stretched across a sub pad to a pickup roll, may be used in some polishing processes. While some wear of the polishing surface of the polishing article 123 will naturally occur during the polishing process, the stability of the polishing surface can be controlled by the incremental advancement of new material into the polishing zone on the platen, as will be discussed further below. In this case, as the pad wears, new material can be incremented onto, or across, the polishing surface with older "used" material being transferred to the take-up roll. It is expected that the increment per substrate could be between about 0.1 mm and about 20 mm per substrate, such as about 1 mm and 5 mm per substrate. The length of the pad material on the roll may define the duration between roll replacement and machine requalification. Hence, the thickness 325 shown in FIG. 3B is kept at a minimum in order to increase the length of pad material on the supply roll, while also achieving desirable polishing process results. Once a break-in (i.e., qualification) of a new roll has been established (typically about 10-20 substrates), a gradient of new-to-used material is established across the polishing surface between the supply roll and the pickup roll. The gradient can be maintained throughout the life of the roll for sequences of substrates to be polished. It is contemplated that, based on the thickness of the polishing article 123, from about 20 feet to about 100 feet of material could be on the supply roll of material.

The polishing article 123 as described herein may be a woven or stacked mat/array of random nano-fibers in a layer having diameters up to about 20 microns. It is contemplated that fibers in a lower diameter range (e.g., nano-fiber diameters from about 10 nm to about 1 μm.) are more desirable due to the benefits of having higher fiber packing density resulting in higher fiber surface contact with the substrate during polishing. The fibers could be of many material types including but not limited to polyolefins, polyesters, polyamides, copolymers, and biopolymers. The nano-fibers may be wettable fibers since, during polishing, the polishing article 123 serves as a transport mechanism for brining slurry to the pad/substrate interface and a material by which the polishing load can be imparted onto the particles in the slurry and onto the film to perform the polishing process.

A unique feature of the polishing article 123 is the ability of the interstices, or spaces, formed between the fibers to act as a reservoir for the slurry to be transported to the pad/substrate interface. Unlike the polymer based pads which rely on texture created from pad conditioning, and surface wettability to bring slurry to the pad/substrate, a "fiber mat" type polishing article can store and/or deliver large amounts of slurry which can be released in volume at the point where the head/substrate compress the polishing article 123 during polishing. A slurry rich polishing condition may be preferable to a slurry starved condition during polishing. Reducing the amount of slurry volume lost per wafer is also a goal if the reduction can be done without compromising polishing results. The interstices between the fibers again serve as a reservoir for the slurry applied to the top surface of the polishing article 123, or through the thickness of the polishing article 123 from a slurry source, while also offering more resistance to the slurry applied to the polishing article 123 being immediately thrown off the pad as a result of platen rotation (due to centrifugal force). With excess slurry transport, it is contemplated that the friction would potentially be lower (a lubricating effect) and the pad/substrate instantaneous temperature would be lower.

Testing has shown that multiple fibrous polishing articles such as the polishing article 123 and/or 305 have polishing results which are similar (higher or lower rate but within 50%) of a baseline using the industry standard IC1010™ pad from Dow®.

Using an ultra-thin or thin polishing article 123, up to about 0.032 inches thick, the mechanical properties of the polishing article 123 will not dominate the tendency to planarize or not to planarize the substrate. A successful polishing article for planarization of features on a substrate is a balance between stiffness, to bridge the portion of the pad between the fibers, and compliance, needed when applying uniform loads dynamically to the substrate surface during polishing. These dynamics are further confounded by abrupt edges, such as edges of a retaining ring (on the carrier head 152 (shown in FIG. 1)) and the leading edge of the substrate during rotation of the pad under the carrier head holding the substrate. The thin polishing article 123 may need to be complimented by a sub-pad which may provide determining pad loading and planarization capability. As shown in FIG. 2, the sub-pad 240 may be part of the machine/web platen and not an integral part of the polishing article 123 (which is a consumable). The mechanical properties of the sub-pad 240 may be determined by the requirements of the polishing step being performed and could possibly be varied during a polishing process to achieve optimal polishing performance.

Testing results using nylon fibers on a polypropylene spun-bond backing material have yielded promising results. It is contemplated that the polypropylene spun-bond backing layer acts as an additional slurry reservoir in parallel to the slurry trapped between the fibers of the polishing article 123. Alternatively, the fibers may be attached to a strong absorbent backing material. Some testing of fiber only polyester fiber pads (without a backing material) has been performed. It is contemplated that the polypropylene spun-bond material behind the fibers is a sub pad, and a sub sub-pad (e.g. the sub-pad 240 shown in FIG. 2) may be utilized to achieve uniformity and planarization. Testing has shown a nominally stable polishing result when using a fiber material (nylon) for as much as 40 minutes of polishing.

While the foregoing is directed to embodiments of the present disclosure, other and further embodiments of the disclosure may be devised without departing from the basic scope thereof, and the scope thereof is determined by the claims that follow.

The invention claimed is:

1. A polishing article, comprising:

a layer consisting of randomly distributed fibers each having a diameter of about 10 nanometers to about 1 micro meter and a density of about 0.1 grams per cubic centimeter to about 50 grams per cubic centimeter, wherein the layer comprises about 5 weight percent to about 30 weight percent of a polymer material and about 5 weight percent to about 30 weight percent of an inorganic material.

2. The polishing article of claim 1, wherein the layer comprises a polishing material that is wound on a supply roll for use on a roll-to-roll polishing system.

3. The polishing article of claim 2, wherein the layer has a thickness less than about 0.032 inches.

4. The polishing article of claim 2, wherein intersections of the fibers comprise a coating.

5. The polishing article of claim 1, wherein the layer is disposed on a backing layer.

6. The polishing article of claim 5, wherein the layer and the backing layer comprises a polishing material that is wound on a supply roll for use on a roll-to-roll polishing system.

7. The polishing article of claim 5, wherein intersections of the fibers comprise a coating.

8. A polishing article, comprising:

a first layer having a thickness of about 0.007 inches to about 0.001 inches comprising random fibers, each fiber having a diameter of about 10 nanometers to about 1 micro meter, wherein the first layer comprises about 5 weight percent to about 30 weight percent of a polymer material and about 1 weight percent to about 30 weight percent of an inorganic material; and a second layer adhered to a backside of the first layer, wherein a coating is disposed on and between two or more fibers in the first layer.

9. The polishing article of claim 8, wherein the first layer comprises a density of about 0.1 grams per cubic centimeter to about 50 grams per cubic centimeter.

10. The polishing article of claim 8, wherein the polishing article is wound on a supply roll for use on a roll-to-roll polishing system.

11. The polishing article of claim 8, wherein the second layer comprises a backing layer.

12. The polishing article of claim 11, wherein the backing layer comprises a hardness of about 50 Shore D to about 65 Shore D.

13. The polishing article of claim 8, wherein the second layer comprises a fiber layer.

14. The polishing article of claim 13, wherein the fiber layer comprises random fibers that are similar to the first layer.

15. A polishing article, comprising:

a fibrous layer consisting of randomly distributed fibers on a backing layer, the fibrous layer having a density of about 0.1 grams per cubic centimeter to about 50 grams per cubic centimeter, wherein the backing layer comprises a hardness of about 50 Shore D to about 65 Shore D, and wherein the fibrous layer comprises:

a composite of about 5 weight percent to about 30 weight percent of a polymer and about 5 weight percent to about 30 weight percent of an inorganic material;

a plurality of interstitial spaces, and a coating that is disposed on and between two or more fibers in the fibrous layer.

16. The polishing article of claim 15, wherein the backing layer comprises a porous structure similar to the fibrous layer.

17. The polishing article of claim 15, wherein the fibrous layer and the backing layer comprises a thickness of about 0.007 inches to about 0.001 inches.

18. The polishing article of claim 17, wherein the backing layer comprises about 10% to about 15% of the thickness.

19. The polishing article of claim 15, wherein each of the fibers have a diameter of about 10 nanometers to about 200 micro meters.

20. The polishing article of claim 15, wherein each of the fibers have a diameter of about 10 nanometers to about 1 micro meter.

* * * * *